United States Patent [19]

Bernstein et al.

[11] Patent Number: 4,516,512

[45] Date of Patent: May 14, 1985

[54] MODULARIZED CARDAN SEWING MACHINE

[75] Inventors: Benjamin T. Bernstein, Highland Park; Thomas J. Bock, Schaumburg; George M. Toman, Chicago; Chandrakant Bhatia, Buffalo Grove, all of Ill.

[73] Assignee: Union Special Corporation, Chicago, Ill.

[21] Appl. No.: 904,205

[22] Filed: May 9, 1978

[51] Int. Cl.[3] ..... D05B 1/10; D05B 57/32; D05B 61/00

[52] U.S. Cl. ..... 112/165; 112/199; 112/221

[58] Field of Search ..... 74/52; 112/55, 199, 112/200, 201, 220, 221, 165, 166

[56] References Cited

U.S. PATENT DOCUMENTS

| | | | |
|---|---|---|---|
| 712,852 | 11/1902 | Rontke . | |
| 1,256,880 | 2/1918 | DeVoe . | |
| 1,569,912 | 1/1926 | Clayton . | |
| 1,650,306 | 11/1927 | Tate | 112/162 |
| 2,193,344 | 3/1940 | Reece | 74/52 |
| 2,667,135 | 1/1954 | Bell | 112/245 |
| 2,704,042 | 3/1955 | Wallenberg et al. | 112/162 |
| 2,760,457 | 8/1956 | Rabezzana | 112/221 |
| 2,834,309 | 5/1958 | Russell et al. | 112/163 |
| 3,016,851 | 1/1962 | Hacklander | 112/200 |
| 3,068,818 | 12/1962 | Schoij et al. | 112/200 |
| 3,318,274 | 5/1967 | Schoij | 112/248 |
| 3,688,711 | 9/1972 | Szostak et al. | 112/221 X |
| 4,022,140 | 5/1977 | Lienemann | 112/199 |

OTHER PUBLICATIONS

Product Engineering, Sep. 28, 1959, pp. 67, 66.

*Primary Examiner*—W. C. Reynolds

*Attorney, Agent, or Firm*—John W. Harbst; John A. Schaerli

[57] ABSTRACT

A sewing machine wherein the various stitch performing instrumentalities are driven by Cardan gear means. Particular sewing part mechanisms are associated with each of said Cardan gear means to produce the desired stitch. Both said sewing part mechanisms and said Cardan gear means being removable, and interchangeable within the frame of the sewing machine.

15 Claims, 14 Drawing Figures

34
22
80
32
36
44
50
54
104
110
64
528
53
52
46
48
142
108
128
B'
Y
X
508
530
131
5
107
105
109
D
Z

MODULARIZED CARDAN SEWING MACHINE

This invention relates to a modularized sewing machine. More particularly this invention relates to an industrial sewing machine wherein the various sewing elements are driven by similar modularized Cardan gear mechanisms.

Industrial sewing machines of the chainstitch and overedge type are based upon the use of a main crankshaft which converts rotary input motion into various reciprocating motions by means of separate and distinct mechanisms. These mechanisms have each traditionally been designed to provide a specific reciprocating motion, such as linear, elliptical, helical and others. This is accomplished by coupling to a main crankshaft various and sundry connecting rods, eccentrics, linkages, cams etc., to provide for the synchronization of the thread handling and material feeding mechanisms.

The large assemblage of moving parts in such machines present severe problems of wear, noise, vibration and overthrow. Due to the large imbalance of inertial forces and moments prevalent in each mechanism, and in the total assembly, noise and vibration of such mechanisms and machines run at a high level. In addition, lubrication of all the various joints, eccentrics, cams and linkages prevalent throughout the machine presents a significant problem in lubrication and heat transfer of high speed rotating and oscillating members.

Due to the high impact and vibration levels prevalent in high speed industrial sewing machines, it has been traditional to house this equipment in heavy metal castings, usually cast iron, in order to reduce machine noise generated by bearing impacts and high vibrations generated by the large imbalance of inertial forces and moments of the reciprocating loads. The design of the traditional and varied mechanisms employed and the presence of a main crankshaft have also directed construction of such machines in casting means.

The invention as hereafter disclosed is an industrial sewing machine having a lightweight casting or frame and which carries a series of generally similar Cardan gear module means. Depending upon the desired stitch the various Cardan gear modules are fitted with particular sewing parts which cooperate to form the required stitch. A single main motor or driving means is provided for actuation of the various Cardan gear modules. Timing belts or other suitable means link the modules to the output shaft of the motor means. The actual placement of the modules and the adjustment of the sewing parts is greatly simplified because the stroke length of each may be substantially the same and each is substantially harmonic. An additional feature resides in the general structural dimensions of the various Cardan gear means. These dimensions are minimal in size, that is as small or smaller than existing components thus greater latitude is provided in their actual placement within the casting. Lubrication of the overall machine is also greatly facilitated in that each module has its own self contained lubrication system with only a main line and drain line extending between the modules thus eliminating the need for the sometimes extensive lubrication systems found in existing industrial sewing machines.

As is apparent there is no direct mechanical interaction between the modules except through belts or compliant members. Each is an entirely separate low vibration device. Thus if changes or adjustments are made in the sewing mechanisms on a particular module these changes are not expected to cause changes in the other parts of the system which must be compensated for. Because of the low vibration generated by the modules over the vast majority of their work cycle, adjustments of the various parts of the system will not cause casting vibrations, casting flexure, etc., which will necessitate compensating adjustment in the other various sewing systems. That is, the adjustment of the sewing parts on a given Cardan gear module is not expected to affect the overall machine combination such that compensating readjustments are necessary on the other modules.

It is an object of this invention to eliminate the main drive crankshaft presently employed in overedge and chainstitch sewing machines. But a further object of this invention is to demonstrate that only one basic drive mechanism can be employed to provide all reciprocating motions required by various thread handling elements in such machines, including but not limited to linear, elliptical, helical and helical/elliptical. Another object of this invention is that when each drive mechanism is enclosed in a housing within given geometric dimensions, a geometry or geometries exist which provides proper synchronization of all thread handling elements in space and time to ensure the formation of various stitch types. Still another object of this invention is to demonstrate that a large number of different stitch types can be produced on a common frame by replacement and interchange of modular drive mechanisms. A further object of this invention is to show that the essentially common reciprocating drive element used for the thread handling components can also be employed as a material feed means or that traditional feed mechanisms can be employed. Another object of this invention is to provide formation of various stitch types from an essentially common modular reciprocating drive mechanism. A further object of this invention is to demonstrate that such modules can be arranged in such a manner as to provide variable timing, if required, by the simple adjustment of pulleys and timing belts. Still another object of this invention is to provide a sewing machine in which all reciprocating or rotating members, with the exception of thread carrying members, are totally enclosed and lubricated. It is another object of this invention to show that the use of a common drive member which can be designed to prevent imbalance of inertial forces and moments for various reciprocating motions removes the constraint of large mass castings as a means of housing mechanism and that such mechanism can now be housed on lightweight frame structures, lightweight castings, or traditional castings to provide a complete sewing machine. Finally, it is an object of this invention to provide a sewing machine in which each reciprocating motion is generally harmonic.

Other features and advantages of the invention will appear from the detailed description of the preferred embodiment of the same which will now be given in conjunction with the accompanied drawings in which.

Figures 6, 7, 11, 12, 13:
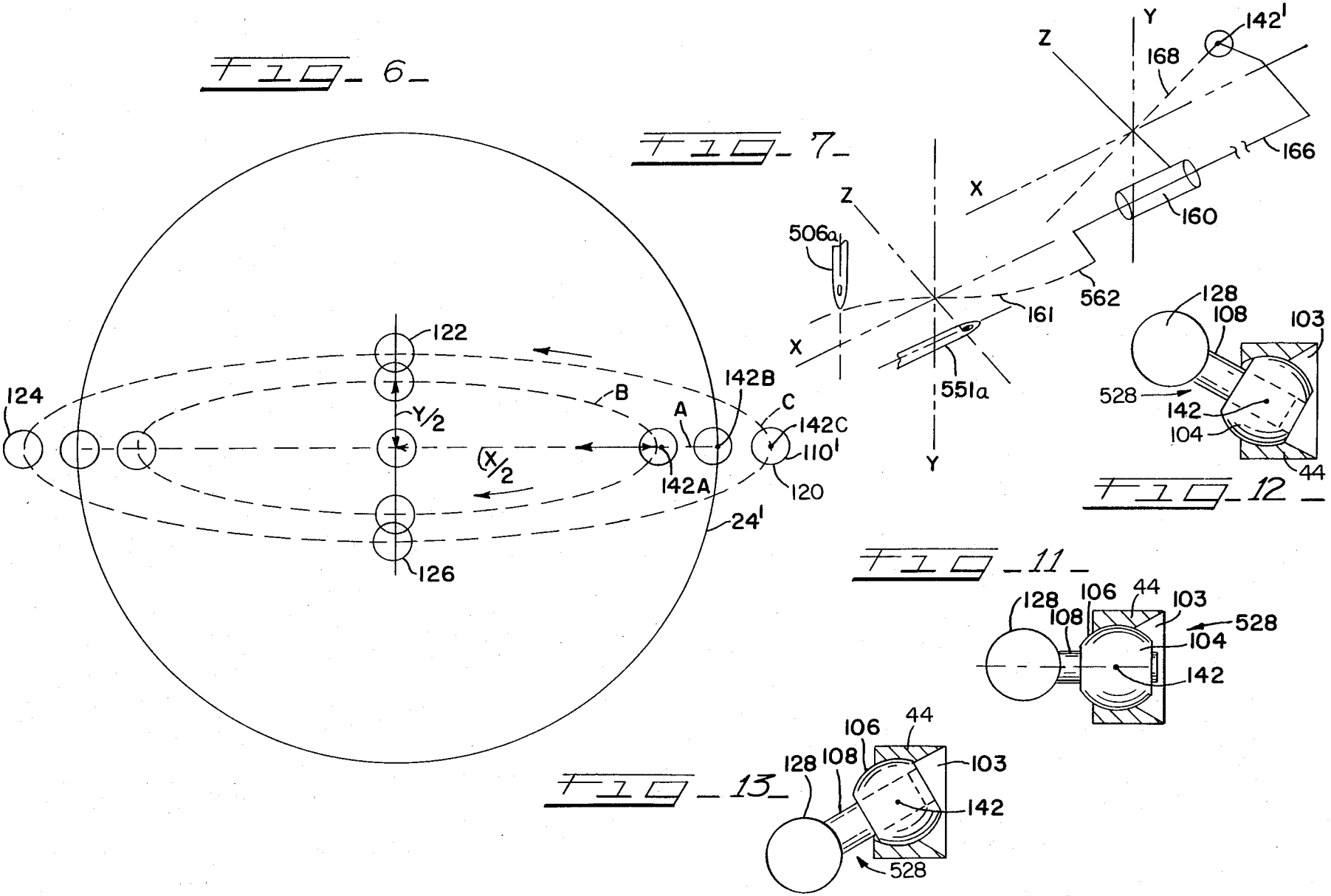
FIG. 6 is a diagrammatic view showing the path of movement of the output centerpoint depending on whether it is positioned on, inside of, or outside of the pitch diameter of the ring gear.
FIG. 7 is a diagrammatic view showing the path of movement of the output centerpoint and the resultant helical path of movement swept out by the tip of the upper looper.
Figure 14:
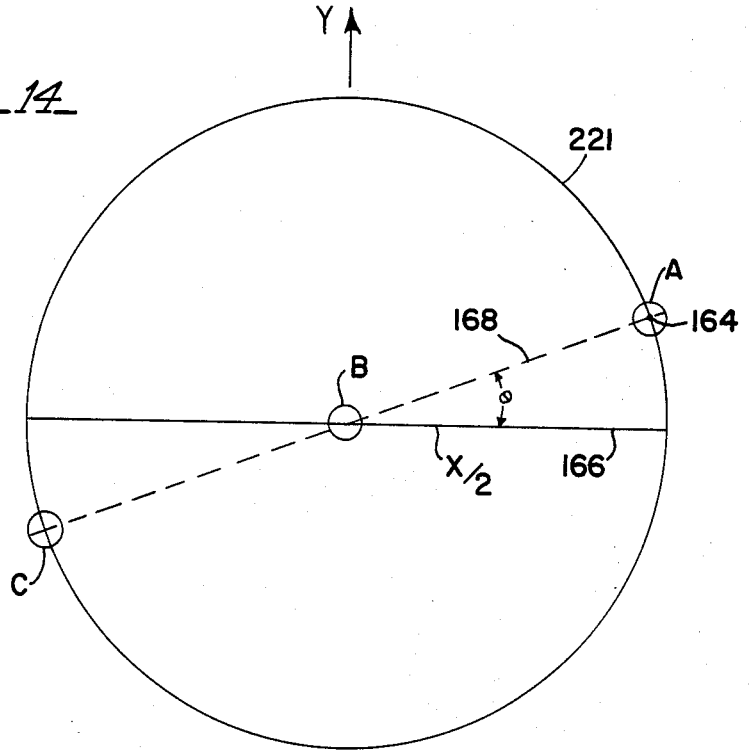
Figure 10:
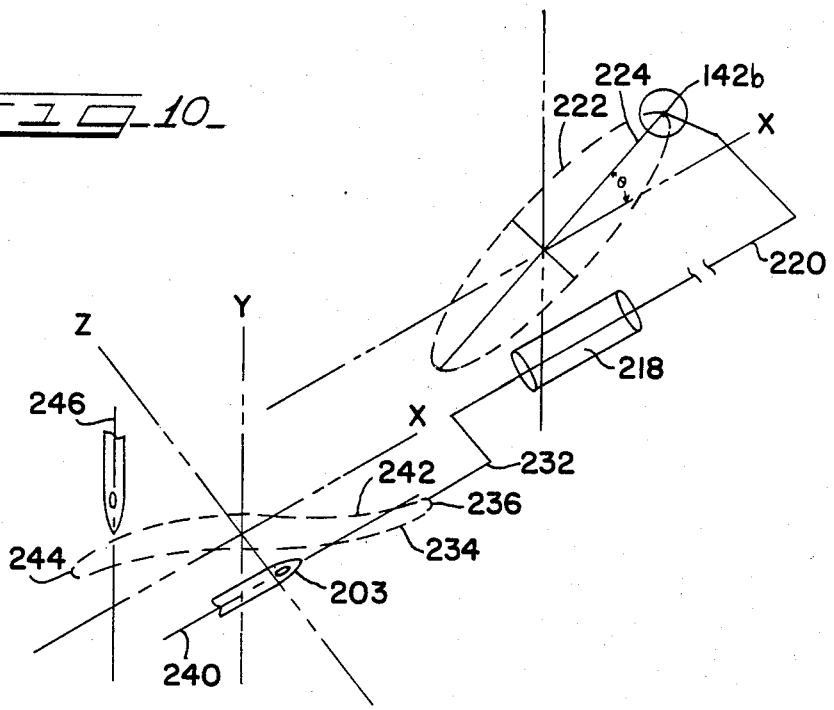

FIG. 10 is a diagrammatic view showing the path of movement of the output centerpoint and the resultant helical/elliptical movement swept out by the tip of the looper as it passes through a work cycle; and FIGS. 11–13 are a partial view showing the relationship of the force transfer means to the output means and looper bar during various points on a work cycle; and FIG. 14 is a diagrammatic view showing the path of movement of the output centerpoint when the major axis thereof is skewed with respect to the major axis swept out by the looper bar.

Figure 1:
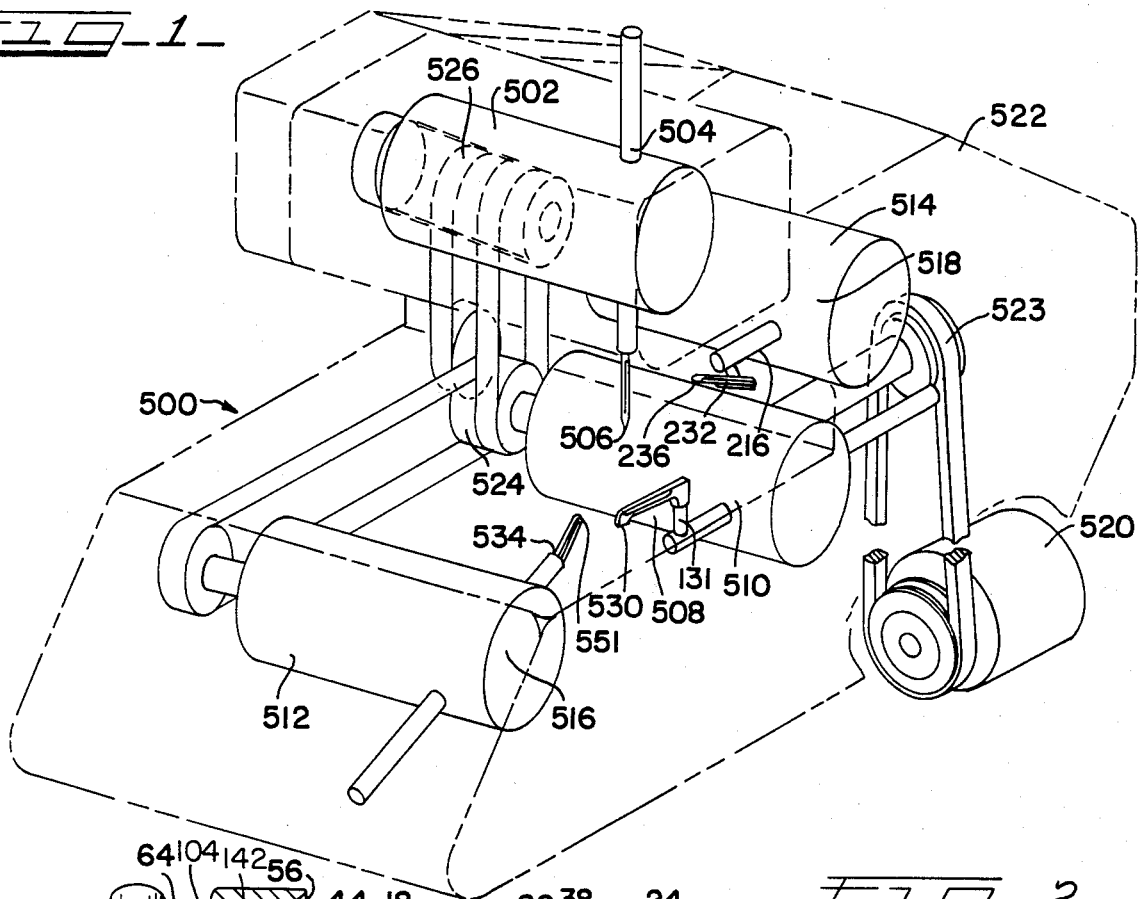
FIG. 1 is a partial isometric view in phantom lines of a sewing machine which can be employed to form either a 401 type stitch or a 504 type stitch.

Referring now to FIG. 1 wherein is shown a stylized sewing machine assembly 500. A series of Cardan gear modules each with related sewing parts means have been placed within the machine for the sake of explanation. In this particular embodiment the sewing parts and related modules can be employed to create either a 401 or a 504 type stitch. Of course, it should be appreciated that by the proper addition or subtraction of Cardan gear modules with the proper sewing parts practically any type of stitch can be created. Thus, some modules and related sewing parts will be used to form a 401 type stitch while others will be allowed to remain idle in the machine or removed therefrom. The stylized sewing machine 600 shown in FIG. 8 for example, employs a series of Cardan gear modules with related sewing parts in a different orientation to create a 503 type stitch. The sewing machine means 500 of the particular embodiment shown includes a series of modules which are all substantially similar. The sewing parts are different such that by their cooperation the desired stitch can be achieved. Included in the combination herein shown is a first Cardan gear module 502 with the related sewing parts 504 such that the needle means 506 can be driven along a straight line path. The Cardan gear means 502 and related sewing parts 504 can cooperate with either a second Cardan gear means 508 and related sewing parts 510 to form a 401 type stitch; or cooperation can be had with third and fourth Cardan gear module means 512 and 514 and their related sewing parts 516 and 518 to form a 504 type stitch. Thus, the module 502 and needle sewing parts 504 can be employed to create either the 401 or the 504 stitch. As will appear apparent to those skilled in the art by substituting the various other sewing parts it would be possible to create a rather extensive number of stitch formations as shown, for example, in FIG. 8. By adding on additional Cardan gear module means 518*a* and spreader sewing parts 514*a* i.e., to a needle sewing part means 504*a* and Cardan gear module means 502*a* even more varieties are possible as one moves into the area of multi-needle machines such as a safety stitch machine. This would include similar elements shown in FIG. 1 with the reorientation of one of the modules and substitution of a spreader means 513 and related parts for a looper and related parts. The spreader can be driven along either a helical or helical-/elliptical path the generation of which will hereafter be explained.

The sewing machine assembly means 500 also includes a motor means 520 which through suitable belt and shaft means such as 523, 524 and 526 combine to drive the various Cardan gear modules. The sewing means 600 is driven in the same manner through a series of belt and shaft means 523*a*, 524*a* and 526*a* for example. As is appreciated, the particular nature of the belting and shaft means will vary depending upon the type of stitch which it is desired to create. The frame or casting 522 or 522*a* employed can be of a lightweight nature. This is due to the fact that the various Cardan modules and related sewing parts have a very high degree of balance and thus contribute minimal vibration, etc., to the frame. In standard machines of this nature massive castings are employed to dampen and absorb vibrations, etc. due to the imbalance nature of the various mechanisms. Another advantage in employing the Cardan gear modules and their related sewing parts has to do with the fact that the output is for the most part harmonic, a fact true of only a few presently employed systems. Additionally there is no direct followed linkage between the various Cardan gear means. Thus, it is possible to service each one independently to the extent where the entire unit may be replaced without adversely effecting the other modules involved. The fact that the modules are in this manner independent of each other also allows one unit or module to be adjusted totally independent of the other modules without the necessity of compensating adjustments.

Figure 2:
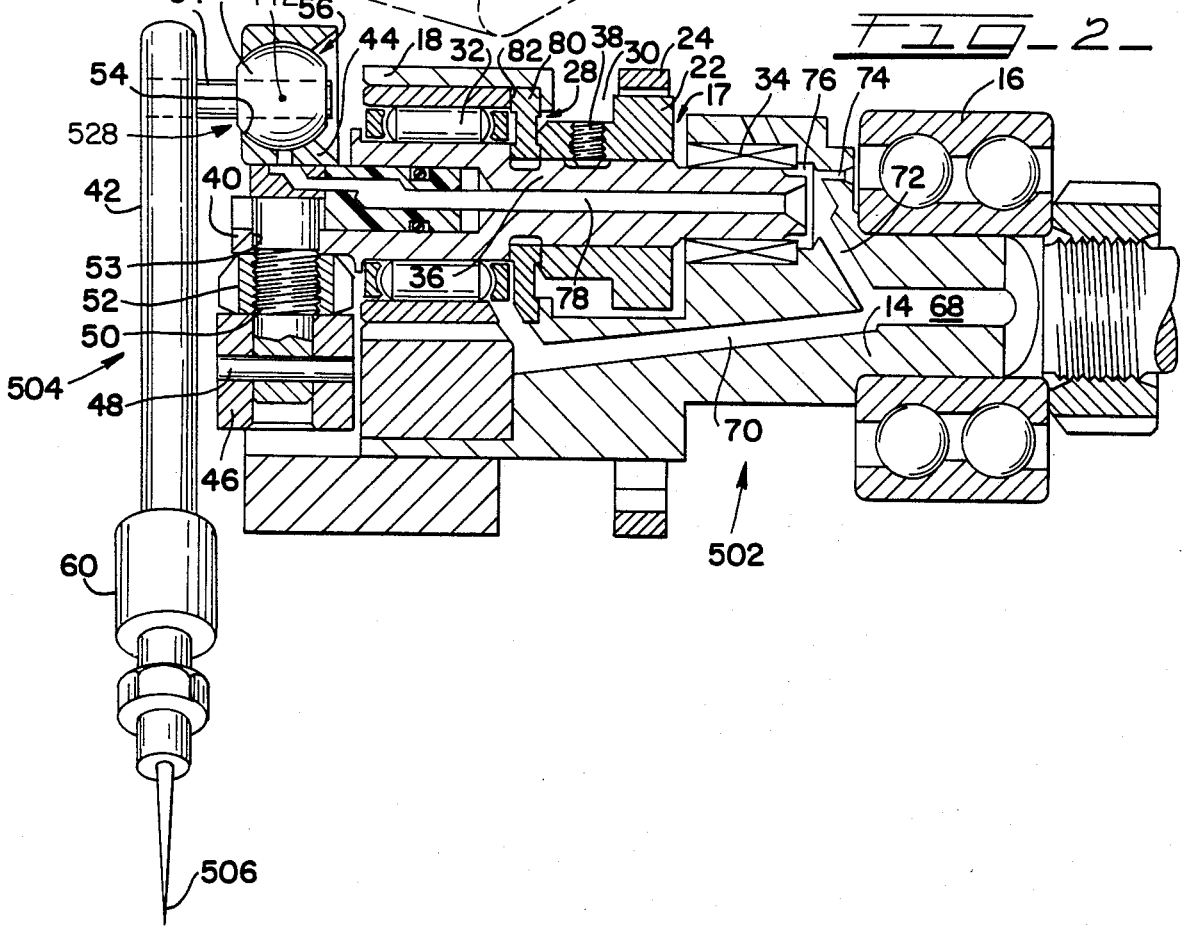
FIG. 2 is a partial view in vertical section of a Cardan gear module having needle sewing parts secured thereto.

The various Cardan gear modules and related sewing parts are the subject of copending patent applications. For example, the Cardan gear module 502 and needle bar sewing parts 504 partially shown in FIG. 2 are covered in copending patent application titled Drive Mechanism For Sewing Machines Ser. No. 908,199 filed May 22, 1978, abandoned.

Referring to FIG. 2 and the Cardan gear 502 has the outer cover removed. As shown there in the Cardan gear 502 is secured generally in a cantilevered manner to the left end portion of the rotationally driven shaft 14.

The module 502 includes an enlarged extension or frame means 18 of shaft 14 and supported in cantilever fashion from bearing 16. As shown, this frame means 18 is shaped to receive a pinion gear assembly 17. The extension is provided with a horizontally extending aperture or cavity 28, as well as a cutaway portion 30. As is apparent, the cutaway portion facilitates the engagement of the pinion gear means 22 with the internal ring gear 24 mounted within the frame. The aperture means 28 carries the double speed bearing means which includes first and second bearing sets 32 and 34 which journal the pinion shaft means 36. The set screw 38 is employed to secure the pinion gear 22 to the pinion shaft 36. Secured to the left end 40 of the pinion shaft 36 is a lever means 44 which connects the work performing instrumentality 42 thereto such that overall a cantilevered system is created. The lever means 44 also connects to the pinion shaft 36 a mass 46 which exerts force on said shaft whereby when balanced by itself there would be a zero load vector exerted on the double speed bearing means. In the preferred embodiment the mass exerting the force is a counterweight means 46 which is secured to lever means 44 with a pin means 48. The lever means 44 is provided with a threaded portion 50 designed for engagement with a spanner nut 52. In the preferred embodiment, the lever means is inserted through the aperture means 53 in the shaft means 36 and the spanner nut 52 securely locks the elements in a predetermined position. The lever means 44 adjacent its top portion is provided with an aperture 54. Securely positioned within said aperture is a ball means 104.

The work performing device in this embodiment, is a reciprocatory needle bar held in position by a force transfer means 528. As is apparent the needle 506 could be substituted by various types of loopers or spreaders. In this event the needle bar would be called either a looper bar or a spreader bar. Connecting the needle bar means and the ball means 104 is a pin means 64. As is apparent, the needle bar is secured for reciprocatory movement by the means 60 which in turn is secured to the frame. Referring to FIG. 2, it is well known that when the output centerpoint (identified by numeral 142) of the Cardan gear is on the pitch diameter of the ring gear 24, the output will be along a straight line path. Also if the output centerpoint is off the pitch diameter of the ring gear it will sweep out an elliptical path. These variables are employed to generate various output motions as will hereafter be discussed.

The bearing sets hereunder discussion, that is, the main bearing set 16, the double speed bearing sets 32 and 34 and the bearing means 56 are all provided with a positive oiling system. Oil enters main channel means 68 under pressure and thereafter passes vis auxiliary channeling to each of the respective bearing sets. Bearing set 32 receives oil via channel means 70, bearing set 16 via channel means 72 and 74, bearing set means 34 via 72 and 76 and bearing means 56 via channel means 72 and 78. Any suitable oil pumping system can be employed as is presently employed in conjunction with industrial sewing machines.

Figures 3, 4, 5:
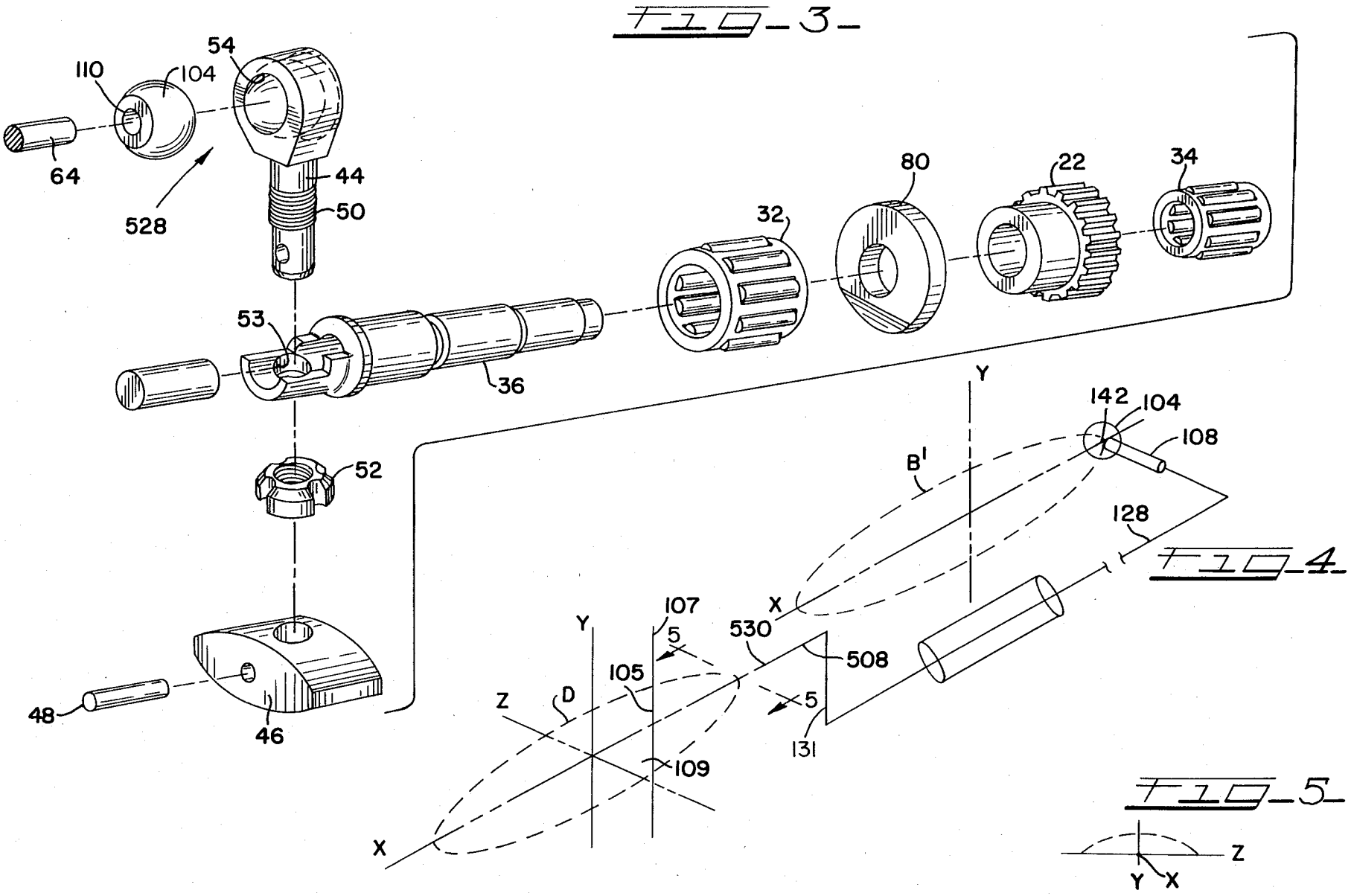
FIG. 3 is an exploded view showing the components included in the force transfer means, some of the elements carried by the pinion shaft means.
FIG. 4 is a diagrammatic view showing the path of movement of the output centerpoint and the resultant ellipse like curve swept out by the tip of the looper.
FIG. 5 is a view taken along lines 5—5 of FIG. 4.

The pinion shaft 36 as shown in FIG. 3 is secured in place by the provision of a thrust washer 80. A combination of the outer race 82 of the bearing set 32 on one side and the frame means 18 on the other secure thrust washer 80. In the preferred embodiment the thrust washer 80 is a material manufactured by the DuPont Corporation under the trade name "Vespel". The thrust washer 80 provides a substantially friction free abutting surface for the pinion gear 22 whereby the pinion shaft and related assemblies are fixed with regard to the frame assembly.

The force transfer means 528 as shown in FIG. 3 and partially in FIGS. 11–13 links the various sewing part assembly means to the corresponding Cardan gear module and is discussed hereafter with respect thereto. The copending patent application Ser. No. 904,203, filed May 9, 1978, abandoned, gives a more complete discussion of the force transfer means and for further information reference should be made thereto.

Referring to the Cardan gear module 508 and related sewing parts 510. It is well understood that the output of a Cardan gear assembly, such as that shown in FIG. 2, can be modified such that a point at the center of the ball means 104 does not sweep out a straight line. In the description hereafter given this point is called the output centerpoint means 142.

For the sake of clarification reference should now be made to FIG. 4 and 6 wherein is shown a partial schematic representation of the front of a Cardan gear assembly showing the path swept out by the output center means 142 of the ball 104. The pitch diameter of the internal ring gear 24 is represented by the circle 24'. The circle 110' represents the aperture 110 in the ball means 104. As shown in FIG. 6, a straight line path A results when the output center point 142 of the ball means 104 is arranged directly on the pitch diameter of the internal ring gear 24 as represented by reference point 142B. This is the standard position wherein a Cardan gear mechanism converts rotary input to straight line output. By shortening or lengthening the lever means 44 through adjustment of spanner nut 52 the output centerpoint means 142 can be moved either inside or outside of the pitch diameter of the ring gear 24 as represented by points 142A and 142C, respectively. The curves B and C represent the corresponding output. That is by simply moving the output centerpoint 142 outside or inside of the pitch diameter of the ring gear 24 an ellipse can be swept out. This ellipse is in the X, Y plane, i.e., the plane of the paper. It is to be noted that the ellipse will be generated in different directions depending on whether the output centerpoint 142 is inside or outside of the pitch diameter of the ring gear 24 which will in turn affect the motion of the looper, etc. As is apparent the farther out or the farther in from the ring gear 24 the greater will become the amplitude or Y axis of the ellipse. Correspondingly the stroke, or X axis of the ellipse, of the looper bar or needle bar will become less as the output centerpoint 142 moves within the ring gear 24 and greater when the centerpoint moves out beyond the ring gear 24. In either case the minor Y axis becomes greater than when the output center point 142 lies on the pitch diameter of the ring gear 24.

Referring now to FIGS. 4,5, 11, 12 and 13 the mode whereby the elliptical motion of the output centerpoint is employed to generate elliptical like motion in the tip (FIG. 1) 530 of the looper will be discussed. Additionally the premise will be made that the output centerpoint 142 will follow the curve identified as C in FIG. 6. Beginning with the position shown in FIG. 11 which corresponds to 120 in FIG. 6, the force transfer means 528 moves to the position represented by 126 during the first quarter of the cycle. In position 126 the relationship of the force transfer means 528 relative to the lever 44 is as shown in FIG. 12. The orientation of the force transfer means 528 when moved to the point 124 shown in FIG. 6 corresponds to FIG. 11. In the position shown at 124 in FIG. 6, a reciprocating motion corresponding to the distance X and a rotational movement which is a factor of the distance Y/2 has thus been imparted to the looper bar 128. Continued actuation of the mechanism will cause the orientation of the force transfer means 528 to assume the position shown in FIG. 13 when at point 122 (FIG. 6) and the return to the orientation shown in FIG. 11 when the cycle is completed. The reciprocatory motion is quite straightforward while the rotational movement occurs as the ball 104 moves above the straight line swept out by the looper bar a maximum distance of Y/2. This is possible because the rod 108 can slide freely into and out of ball 104 within aperture 110. The looper bar 128 is thus passed through a reciprocation corresponding to distance X while it is rotated through an angle which is a factor of the distance Y.

It should, however, be understood that while the minor axis in curve B' in FIG. 4 is in the Y, X plane, in curve D the minor axis is generally in the X, Z plane. In both curves the major axis will be in the X, Y plane. Depending on the geometric orientation between the looper 508 and looper bar 128 the minor axis can be adjusted to lie in a plane rotated around the X axis for 360 degrees. That is, both the rod 108 and looper 508 are secured, in the preferred embodiment, to the looper bar 128. A phase angle thus exists between the minor axis with reference to that of the looper bar 128 and by varying this phase angle the output curve of tip 530 can be made to be in many various planes.

Bearing these factors in mind, turning again to FIGS. 4 and 5. The ellipse like curve swept out by the output centerpoint 142 of the ball 104 is represented by B'. The looper 128 is constrained from any other movement other than reciprocation along its major axis, and rotation around its major axis. For the sake of explanation let it be stated that the major and minor axes of curve B' lie within the plane of the paper and the major axis of the looper bar 128 is parallel and spaced therefrom. Let it also be stated that the major axis of curve D lies within a plane which is parallel with the plane of the paper but spaced therefrom. Of course the curve D also lies in the Y and Z diamensions as well. The looper 508 since it is fixedly secured to looper bar 128 follows both the reciprocative as well as rotational movement thereof. Thus the tip 530 of the looper sweeps out an ellipse like curve as represented by line D. An end view of ellipse D is shown in FIG. 5. Beginning with a curve B' in the X major and Y minor planes, a curve D is generated which lies in three dimensions. This ellipse like curve represents the necessary path that the looper tip 530 must sweep out in cooperation with the needle 506 to form the desired 401 type stitch.

The line 107 as shown in FIG. 4 represents the general path taken by the needle during the formation of the 401 stitch. The area 105 is representative of where the tip 530 of the looper enters the thread loop created on the back side of the needle 506. The point 109 is representative of where the tip of the looper is when the needle 506 enters the triangle formed on the back side of the looper.

The length of the major axis of the ellipse D will correspond somewhat in length to that of the ellipse which is swept out by the output centerpoint 142 of the ball 104. The length of the minor axis of the ellipse like curve D will depend on a number of factors. For example, the distance which the output centerpoint 142 is from the pitch diameter of the ring gear 24', the length of the rod 108 and the length of the looper arm 131. These different parameters can be jointly or singly varied such that for a given major axis of curve D the minor axis can be made larger or smaller while the phase angle determines the plane relationships. Any number of adjustable securing means can be employed such as a lock screw, clamp, etc. For a complete reference should be made to copending patent application Ser. No. 904,204 filed May 9, 1978 U.S. Pat. No. 4,344,376.

The Candan gear module 514*a* and related sewing parts 518*a*, are further referred to in FIGS. 7 and 14 where they are disclosed in diagrammatic form for simplicity. It must be appreciated that the tip 562 of the spreader will sweep out an outwardly extending helical like path toward needle means 506*a*. The line 221 (FIG. 9) represents the pitch diameter of ring gear such as ring gear 24 in FIG. 2. The straight line path swept out by the center of spreader bar means 556 and output center 142' of the corresponding force transfer means are represented by lines 166 and 168 respectively. These two straight line paths are in parallel spaced apart planes. That is in FIG. 7 path 168 would be within the plane of the paper while path 166 could be included in a plane somewhere above the plane of the paper. Both of these resepective planes being parallel and spaced apart while the straight lines 166 and 168 are skewed at an angle theta to each other as shown in FIG. 14.

The relationship of the spreader bar 556 to its force transfer means at the beginning of the cycle corresponds to FIG. 13.

At the beginning of the cycle, the spreader bar 556 and force transfer are in the position "A" shown in FIG. 14. As the assemblies move toward position "B" in FIG. 14 which correspond to FIG. 11, translational and rotational forces have been transferred to spreader bar 556. Because the centerline of the bar corresponds to line 166 and the output centerpoint 142' corresponds to line 168 both as shown in FIG. 7 it is apparent that the pin will slide farther into the ball means. This sliding is accomplished with the resulting rotation of the shaft 556. As the force transfer means continues thereafter to be swept along path 168 it eventually reaches the end of the stroke represented by "C" in FIG. 14. The tip 562 of the spreader means 513 during this time is sweeping out a path corresponding to path 161 shown in FIG. 7. In a preferred embodiment the tip 562 is swept through only a portion of the total possible helix. The motion, however, carries it in back of the lower looper means 551*a* and in front of the needle tip means 506*a*. In position "C" of FIG. 14 the respective elements assume the orientation as shown in FIG. 12. The spreader bar means 556 has been rotated through an angle and reciprocated through a stroke or translational distance. The return stroke is back along the same path, corresponding to path 166 in FIG. 7, whereby passing through position "B" to initial position "A", the tip 562 passing back along path 161. This constitutes a complete work cycle necessary to form a single stitch. As is appreciated during this cycle the output centerpoint 142' moves in X and Y dimensions, while the tip 562 moves in the X, Y and Z dimensions. The center of bar 556 however moves only in the X dimension.

The stroke or translational distance that the looper bar means 556 is moved through depends upon the stroke of the output lever means. The stroke of the output lever means in turn depends directly upon the size of the Cardan gear being employed to drive it. As is appreciated in order to achieve a straight line output the centerpoint 142' must be positioned directly upon the pitch diameter of the ring gear represented by line 221. As stated previously further information on the construction and mode of operation of the Cardan gear assembly reference should be made to copending application Ser. No. 908,199, abandoned. The helical path 161 as shown in FIG. 7 is achieved by skewing the path 166 of bar means 556 through some angle theta from the path 168 swept out by the output center means 142'. The magnitude of theta will determine both the rotation and the translation of the helical path 161. The larger the angle the greater will be the rotation of the helical path and the shorter the translation. Conversely the smaller the magnitude of angle theta the greater the translation and smaller the rotation of the helical path. It should be appreciated that in the embodiment herein disclosed, it is possible to achieve only about the first 90° of the helix. This restraint is placed upon the system becase of the design of the force transfer means.

The particular angle theta which exists between the paths 166 and 168 can be achieved in various manners. For example, the support means for the bearing 60 can be provided with an adjusting means. The adjusting means allows the angle theta to be varied within a predetermined range. Another mode of adjustment involves the housing support of the Cardan gear assembly. The housing support can be provided with an adjustment whereby the entire Cardan gear can be rotated one way or the other to create the desired angle.

As is apparent in this particular type of stitch the module 508*a* is not employed. Additionally the spreader 513 could be replaced with a looper means to create yet another stitch type.

Figure 9:
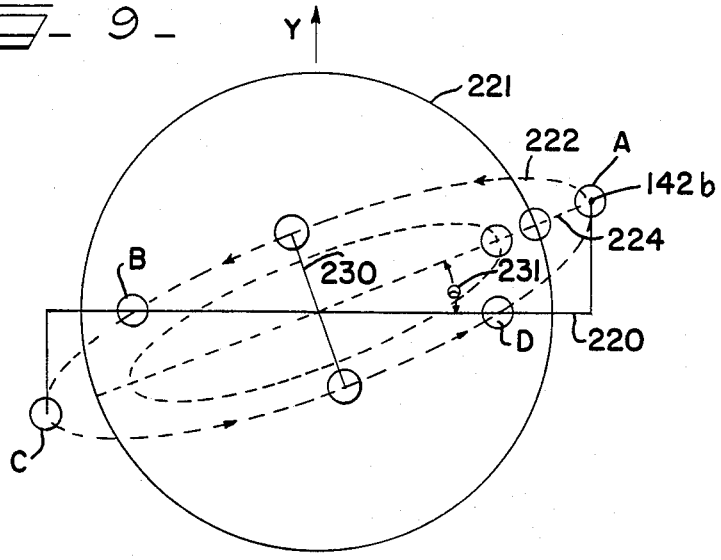
FIG. 9 is a diagrammatic view showing the path of movement of the output centerpoint when it is on or off the pitch diameter of the ring gear and has the major axis of the resulting ellipse skewed with respect to the major axis swept out by the looper bar.

A Cardan gear module such as 514 (FIG. 1) with the related sewing parts 518 for developing a helical/elliptical like output is shown in FIGS. 9, 10 and 11–13. Referring now to FIG. 9 wherein is shown the general movement of the output centerpoint 142*b* when it is outside the pitch diameter of the ring gear represented by circle 221. It is well known that upon moving the centerpoint 142*b* of the output means in or out from the pitch diameter of the ring gear 221 will cause it to travel along an elliptical path in opposite directions. Take, for the sake of example, the ellipse 222 which has a major straight line axis 224. The straight line major axis 224 as shown in FIGS. 9 and 10 is in a plane which is parallel with but spaced apart from the plane wherein is carried a straight line 220. For the sake of explanation, let it be assumed that this plane is in the X, Y axis which corresponds to that of the paper. That is straight line 224 is in a first plane which is parallel with but spaced apart from a second plane wherein is carried straight line 220. It will be noted from a consideration of FIG. 10 that straight line 220 is skewed in the second plane with respect to the straight line 224.

Because of the existence of a force transfer means such as 528 between the looper bar 216 (FIG. 1) and output center means 142*b* it is possible to transfer force therebetween. Thus as the output centerpoint 142*b* moves along ellipse 222 translational force will be transferred to the looper bar 216 causing it to move along line 220. Additionally as the slider pin portion and the ball means slides within the socket rotational force is transferred. Rotational force generally corresponding to about one half the length of line 230 will be imparted to the looper bar means 216. This is the looper bar 216 will be rotated a distance equal to ½ the minor axis of ellipse 222. The translational movement imparted to the looper bar means 216 will be some distance less than the length of line 224.

Figure 8:
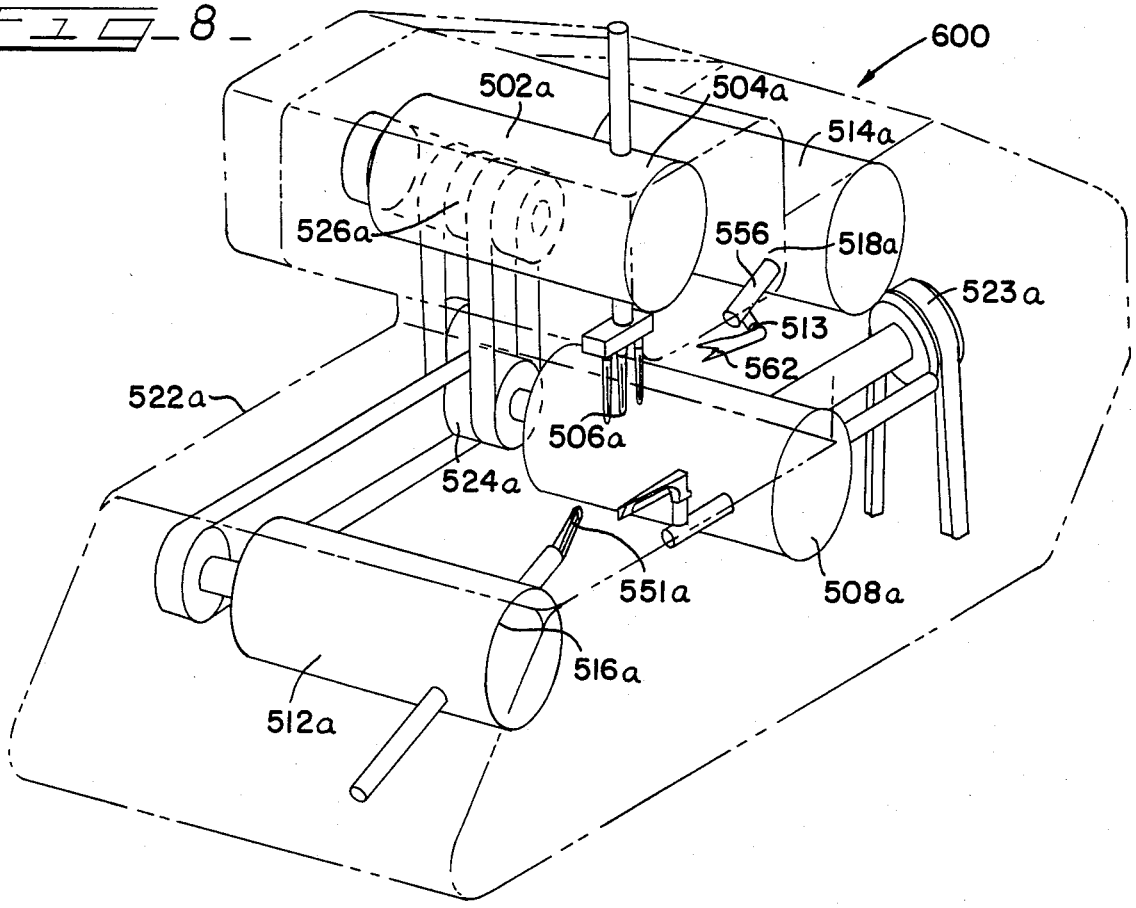
FIG. 8 is a partial isometric view in phantom lines of a sewing machine which can be employed to form stitches wherein a spreader is employed.

A point therefore on the surface of the looper bar 216 will be moved transversely and simultaneously rotated. A looper means or other work performing instrumentality 232 will thus be moved through a generally elliptical/helical path such as line 234 (FIG. 10). This motion in fact being a general combination of the helical and elliptical motion previously discussed. This path 234 is swept out in this particular example by the tip 236 of the looper 232. It should be noted that the path 234 includes a full ellipse in combination with a part of a helix. That is the tip 236 is swept through about a complete ellipse like curve but only about the first one third or so of a complete helix. The lead and diameter of the particular helix will be determined by the angle theta 231. The angle theta represents the number of degrees whereby line 224, swept out by centerpoint 142*b*, is skewed with respect to line 220 which is swept out by looper bar 216. The elliptical portion of path 234 is contributed by moving the output centerpoint 142*b* off the pitch diameter of the ring gear. That is, some distance either in or out of the pitch diameter, the distance determining the size of the major and minor axis. For a more complete discussion of the helical/elliptical, reference should be made to copending patent application Ser. No. 904,207, U.S. Pat. No. 4,362,113. As is apparent, the looper 232 can be substituted by a spreader means such as shown in FIG. 8 and module 518*a*.

Referring again to FIG. 8 wherein is shown a stylized sewing machine having a first Cardan gear module 502*a* with related sewing parts 504*a* such that the needle means 506*a* can be driven along a straight line path. The second Cardan gear means 514*a* and related sewing parts 518*a* cooperate to drive the spreader means 513 along a helical/elliptical like path such as that shown in FIG. 10. The third Cardan gear module 512*a* and related sewing parts 516*a* cooperate to drive the looper means 551*a* along an elliptical like path such as that shown in FIG. 4. As is apparent with these particular modules and related sewing parts, with the exception of the addition of two more needles to the existing needle bar, it is possible to create a stitch such as a type 605. For a complete explanation of the type 605 stitch reference should be made to "Stitch Formation Type 605" published by Union Special Corporation, 400 North Franklin Street, Chicago, Illinois 60610. With the particular arrangement of modules and related sewing parts shown in FIG. 8 it is possible to create a type 503 stitch without the substitution of elements necessary for the type 605 stitch.

Depending on whether it is acceptable to have a simple helical output as shown in FIG. 7 or whether it is desirable to have a helical/elliptical output as shown in FIG. 10 will determine which module and relating sewing parts will be employed. Here again reference should be made to the corresponding identified copending patent applications for a full discussion of the particular mechanical features of these various devices.

The employment of such Cardan gear modules and related sewing parts thus provides the opportunity to build machines on a modular basis. The fact since the Cardan gear modules themselves are substantially identical it only becomes a matter of substituting the various sewing parts on the Cardan gear modules to achieve the desired stitch forming function. Thus, for a very broad spectrum of stitches most of the elements involved in the sewing machine assembly are standard. This is a very great advancement over the present state of the art wherein few if any assemblages within a given machine are similar and practically no similarity exists between machine classes.

With the invention as herein disclosed it becomes possible simply by connecting the modularized Cardan gear assemblies with the proper sewing parts and lightweight casting to convert a machine sewing a 401 stitch to one sewing a 504 stitch or by the inclusion of two needles to convert to a safety stitch machine. From a manufacturing standpoint the advantages which flow from this system are very much in evidence. Fewer mechanisms in greater volume will be constructed. Lower inventories, fewer parts, will be necessary, substantially fewer different parts will be needed to construct the entire machine, a given casting or frame will have uses for a multiplicity of different sewing machine classes, such as overedge, flatbed, or safety stitch.

As is apparent the stroke or the straight line distance over which the tip of the work performing means is moved may be varied. This result is accomplished by changing the dimensions of a number of the elements which comprise the Cardan Gear module. For example, the needle Cardan Gear module must be passed through a longer stroke (to accomodate multiplys of material) than most loopers. The looper always moves thread and thus is not effected by the number of plys of material being sewn.

An advantage achieved by shortening the stroke length of, for example, the looper, has to do with the fact that less mass will be involved in the shorter stroke design. The lowered mass, although itself not great, results in a very favorable reduction in the magnitude of acceleration. Less inertial loading on the double speed bearings results in a longer life thereof, at the same speeds, or the same life at higher speeds. The disadvantage being that a larger inventory of elements will have to be maintained.

While a preferred embodiment of the invention has been described and shown in some detail it will be understood that various changes may be made in the construction and arrangement of parts without departing from the invention as defined by the appended claims.

What is claimed:

1. A sewing machine adapted to create stitches comprising:

a Cardan gear driven needle module means driving at least one needle means; and at least one Cardan gear driven looper module means driving looper means for cooperating with said needle module means.

2. The sewing machine of claim 1 wherein said Cardan gear driven needle module and said at least one Cardan gear driven looper module means cooperate to form a 401 type stitch.

3. The sewing machine of claim 1 wherein a second cardan gear driven looper module means driving looper means is provided, and wherein said Cardan gear driven needle module means and said at least one and said second Cardan gear driven looper module means cooperate to form a 504 type stitch.

4. The sewing machine of claim 1 wherein said Cardan gear driven needle means includes two needle means, and said at least one Cardan gear driven looper module means cooperate to form stitches of the Class 600 type.

5. The sewing machine of claim 1 wherein said Cardan gear driven needle means includes at least three needle means, said at least one Cardan gear driven looper module means, and a Cardan gear driven spreader module means cooperate to form a 605 type stitch.

6. A sewing machine having a series of means operative which cooperate to form particular stitch types comprising:

a first Cardan gear means driving a needle means along a straight line path; and a second Cardan gear means driving a looper means along an ellipse like path.

7. A sewing machine wherein a number of the thread manipulating means are driven by similar units comprising:

a needle means driven by a first Cardan gear means in a reciprocative manner along a straight line path; and a looper means cooperating with said needle means to form a stitch, driven by a second Cardan gear means which has an output centerpoint means and a force transfer means.

8. The sewing machine of claim 7 including:

a second looper means cooperating with said looper means driven by a third Cardan gear means which has an output centerpoint means and a force transfer means.

9. The sewing machine of claim 8 wherein said needle means, said looper means and said second looper means cooperate to form a 504 type stitch.

10. A sewing machine means designed to create an overedge type stitch comprising:

at least one Cardan gear module means having sewing parts for driving an upper looper means along a helical/elliptical like path;

at least one Cardan gear module means having sewing parts for driving a lower looper means;

at least one Cardan gear module means having sewing parts for driving a needle means along a straight line path; and a frame means carrying said Cardan gear module means whereby said needle and loopers sewing parts cooperate to form the desired stitch type.

11. The sewing machine of claim 10 wherein said Cardan gear module means do not all have the same stroke.

12. A sewing machine means designed to create a double locked type stitch comprising:

at least one Cardan gear module means having sewing parts for driving a looper means along an elliptical path;

at least one Cardan gear module means having sewing parts for driving a needle means along a straight line path; and a frame means carrying said Cardan gear module means whereby said needle and looper sewing parts cooperate to form the desired stitch type.

13. The sewing machine of claim 12 wherein said Cardan gear module means do not all have the same stroke.

14. A sewing machine adapted to create stitches comprising:

a series of Cardan gear module means;

a series of sewing mechanism means corresponding to the number of Cardan gear module means, each of said module means being fitted with one of said sewing mechanism means;

a frame means replaceably carrying said series of Cardan gear module means;

a motor means having an output means;

a series of belt means transferring force from said output means to said Cardan gear module means.

15. The sewing machine of claim 14 wherein said Cardan gear module means do not all have the same stroke.

* * * * *